US005519922A

United States Patent [19]

Strudel

[11] Patent Number: 5,519,922

[45] Date of Patent: May 28, 1996

[54] COMBINED SPREADER AND SQUEEZE APPARATUS FOR TUBULAR KNITWARE

[75] Inventor: Werner Strudel, Friedrichshafen, Germany

[73] Assignee: Lindauer Dornier Gesellschaft mbH, Lindau, Germany

[21] Appl. No.: 322,051

[22] Filed: Oct. 12, 1994

[30] Foreign Application Priority Data

Oct. 13, 1993 [DE] Germany ..... 43 34 897.1

[51] Int. Cl.[6] ..... D06C 5/00; D06B 15/02

[52] U.S. Cl. ..... 26/85; 26/84; 68/22 R

[58] Field of Search ..... 26/80, 83, 84, 26/85, 51; 68/22 R

[56] References Cited

U.S. PATENT DOCUMENTS

| | | | |
|---|---|---|---|
| 2,045,755 | 6/1936 | Cohn | 26/85 |
| 2,294,642 | 9/1942 | Wedler | 26/85 |
| 3,501,818 | 3/1970 | Heitkamp | 26/85 |
| 3,616,502 | 11/1971 | Aronoff | 26/85 |
| 4,885,826 | 12/1989 | Strudel | 26/80 |
| 5,233,734 | 8/1993 | Strudel et al. | 26/80 |
| 5,279,023 | 1/1994 | Strudel et al. | 26/85 |

FOREIGN PATENT DOCUMENTS

| | | |
|---|---|---|
| 3732754 | 9/1987 | Germany . |
| 4123477A1 | 7/1991 | Germany . |

*Primary Examiner*—Amy B. Vanatta
*Attorney, Agent, or Firm*—W. G. Fasse; W. F. Fasse

[57] ABSTRACT

Tubular knitted fabric is circularly spread and simultaneously squeezed for removing treatment liquor. Spreader components are separated from squeezing components in order to relieve the spreader components from the squeezing forces. For this purpose, pairs (23) of squeezer rollers (23A, 23B) are mounted on brackets (24, 25) which are rigidly secured to the outer pipe section (19A) of the central carrier column (19). The brackets (24, 25) are so arranged that they do not interfere with the spaced struts or braces (20, 21) of the spreader rollers (12). Each pair of squeezer rollers (23) cooperates with a revolving single squeeze roller (26) that is radially adjustable by a power drive such as a piston cylinder device (27) relative to the central column (19) to thereby adjust the squeezing gap between the pair of squeezer rollers and the single squeeze roller and thus also the squeezing force. The adjustment of the squeezing gap also determines the squeezing forces, whereby the arrangement is such that squeezing force components exerted by neighboring squeezer units support each other directly.

8 Claims, 4 Drawing Sheets

COMBINED SPREADER AND SQUEEZE APPARATUS FOR TUBULAR KNITWARE

FIELD OF THE INVENTION

A combined spreader and squeezer is used for treating tubular knitware to simultaneously spread out the initially rope-like wares or goods and squeeze out any treatment liquor.

BACKGROUND INFORMATION

Devices of the above type are preferably used for avoiding so-called edge markings in tubular knitware that has been subjected to a wet finishing treatment. Such edge markings may occur when the treatment liquor is squeezed out of the goods.

German Patent Publication DE-OS 4,123,477 A1 corresponding to U.S. Pat. No. 5,279,023 (Strudel et al.) discloses a method for avoiding edge markings in tubular knitted fabrics and an apparatus for carrying out such a method. In the known apparatus the tubular fabric is passed through between a rotatable inner squeeze roller system that is adjustable in its diameter and an outer rotatable squeeze roller system. The structural features of the inner squeeze roller system correspond to that of a tubular fabric spreader as disclosed in German Patent Publication DE-PS 3,732,754 corresponding to U.S. Pat. No. 4,885,826 (Strudel) with the modification that at the free ends of the struts carrying the longitudinal guide elements, the elements have been replaced by one pair of squeeze rollers at each free support or strut end. Each pair of squeeze rollers of the inner system forms together with an individual squeeze roller of the outer system a so-called partial squeezer or squeezer device comprising primarily three cooperating squeeze rollers.

When squeezing the liquor out of the tubular fabric the roller of the outer system which is positively driven engages between the squeeze rollers of each pair of squeeze rollers of the inner system, whereby the treatment liquor is squeezed out of the tubular fabric to a large extent.

If, due to the diameter of the tubular fabric only a small spreading is required or even permissible, then the supports or struts of the inner system extend at a relatively flat or acute angle relative to the longitudinal axis of the central spreader carrier column. As a result, the forces effective on the supports or struts and on the bearings or pivots of the supports or struts are effective with a relatively large mechanical advantage. As a result, the elements of the spreader must be correspondingly heavy dimensioned, whereby the weight of the entire structure is increased.

U.S. Pat. No. 5,233,734 (Strudel et al.) discloses a circular spreader with a locking mechanism for keeping the spreader in a spread condition. A fabric guide head has pairs of rollers which cooperate with individual positioning rollers. The just described prior art leaves room for improvement, especially with regard to achieving a simultaneous spreading and liquor squeeze out.

OBJECTS OF THE INVENTION

In view of the above it is the aim of the invention to achieve the following objects singly or in combination:

- to relieve the components of the spreader squeezer mechanism specifically the supports or struts of the central carrier of the squeezing forces which are generated by the squeezers to thereby avoid the massive and heavy construction of these components;
- to make sure that the knitted tubular fabric is properly guided through the squeezer and that edge marks are avoided;
- to construct the supports for squeezer units and the position of these squeezer units in such a way that the squeezing forces counteract each other to reduce the mechanical load on these components; and
- to make sure that the squeezing gap in a squeezer is adjustable and to further assure that the treatment liquor is uniformly squeezed out of the tubular fabric all around the tubular fabric.

SUMMARY OF THE INVENTION

The above objects have been achieved according to the invention by the combination of the following features. Squeezer roller pairs (23, 23A, 23B) are rotatably mounted on stationary brackets (24, 25) secured to an outer pipe section (19A) of the spreader carrier central column (19) so that the squeezer roller pairs (23, 23A, 23B) are separated from the supports or struts (20, 21) of the central spreader carrier that includes the just mentioned central column (19). Each squeezer roller pair (23) rotates with the column (19) driven by a first power drive (32) such as a motor driven gear train. Each pair (23) further cooperates with a respective single squeeze roller (26) that is radially adjustable by a second power drive (27) such as a piston cylinder device. Each single squeeze roller (26) is also positively driven by a third power drive (33), such as a motor driven gear train for revolving the single squeeze roller (26) with its second power drive (27) around the column (19). Further, each squeeze roller (26) with its second power drive (27) is mounted to a pair of ring bearings (28) or mounting rings in such a way that each single squeeze roller (26) is mounted with its rotational axis at the corner of a triangle with the rotational axes of the pair of squeezer rollers (23A, 23B) mounted at the two other corners of said triangle so that squeeze force components applied by the second power drive (27) directly oppose each other, whereby loads on the apparatus components are substantially reduced.

A pair of squeezer rollers (23) and the respective cooperating single squeeze roller (26) with its second power drive (27) form together a squeezer unit, in which the three squeeze rollers are mounted with their rotational axes at the corners of said triangle. These squeezer units are preferably uniformly angularly spaced around respective mounting rings. Depending on the number of such units in the apparatus, the angular uniform spacing between these units will vary. For example, if three such units are provided, the on-center angular spacings between neighboring units will be 120°. If four such units are used, the on-center angular spacing will be 90° and the units will be arranged directly diametrically opposite each other around the spreader carrier central column. In all of these arrangements the squeezer force components of neighboring rollers are so directed that these force components oppose each other.

Spreader elements, for example, spreader rollers are mounted at the free ends of the struts or braces of the central carrier instead of the squeezer roller pairs which according to the invention are mounted, as mentioned above on the separate brackets secured to the central spreader carrier column, more specifically to the outer pipe section of the central column.

The central carrier column is constructed of two pipes or pipe sections that telescope relative to each other, whereby the squeezer roller pairs are mounted on the respective stationary brackets secured to the outer pipe or pipe section. These brackets are stationary relative to the pipe sections to which they are rigidly mounted so as to rotate with the pipe section and thus with the central spreader carrier. These brackets are properly spaced from each other in the axial direction for rotatably mounting the squeezer roller pairs. The brackets carry bearings for rotatably mounting the squeezer roller pairs.

The above mentioned second power drive, for example, in the form of a piston cylinder device permits a controlled adjustment of the position of the respective single squeeze roller radially relative to the central column toward and away from the corresponding pair of squeezer rollers that form together with the single squeeze roller the above mentioned spreader and squeezer unit.

The longitudinal axis of three rollers of a squeezer unit are arranged at an angle slanting relative to the central longitudinal axis of the central carrier column. This feature makes sure that the tubular knitware or fabric which has been spread by means of the spreader elements carried by the braces or struts and which fabric is guided between the components of the spreader units, is fully squeezed all around in the revolving direction of the single squeeze roller. This feature also assures that the fabric is properly guided through the squeezer units while the treatment liquor is being squeezed out. The single squeeze roller is driven by a third power drive such as a motor gear drive to revolve around the central carrier column.

The construction according to the invention has the advantage that the squeezing force components exerted by the individual squeezer units directly counteract each other to thereby reduce the loads on the system. Due to the arrangement of the individual squeezer roller pairs on the brackets secured to the central column the braces and struts and the bearings or pivots of the braces and struts are no longer exposed to the squeezing forces. The braces and struts of the central carrier merely have to take up the forces that are necessary for spreading the tubular fabric. Thus, according to the invention separate components take up the spreader forces on the one hand and the squeezing forces on the other hand which substantially reduces the overall weight because lighter components can now be used.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
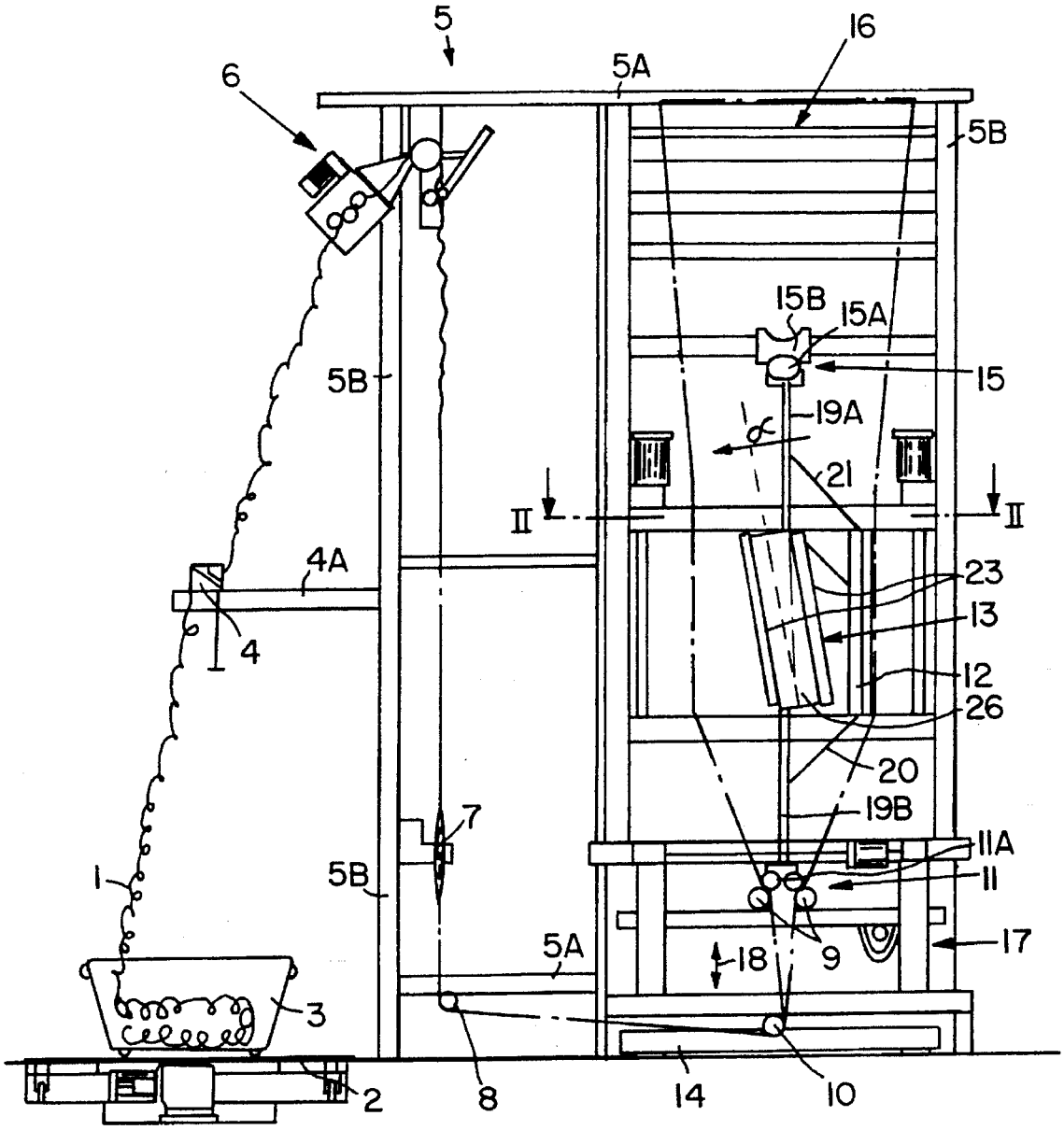
FIG. 1 shows a schematic side view of the integrated spreader and squeezer mechanism of the invention.

Referring first to the overview of FIG. 1, the tubular fabric or knitware 1 is supplied, still in rope form, in a vessel 3 that collects any treatment liquor dripping off the fabric. The vessel 3 is supported on a turntable 2. The rope-shaped fabric 1 runs out of the vessel 3 to variable tension rollers 4 mounted on a bracket 4A to a machine frame 5 having cross-beams 5A and uprights 5B. From the variable tension rollers 4, the fabric 1 runs to an untangling head 6 which guides the fabric through a flat spreader 7 over first and second guide rollers 8 and 10 as well as smoothing rollers 9 onto the central spreader to be described in more detail below. The flat spreader 7 holds the fabric spread, however, still in a flat condition. The second guide roller 10 is arranged below the smoothing roller pair 9 that forms part of a lower spreader head 11 which also includes support rollers 11A. The fabric 1 runs between the support rollers 11A and the smoothing rollers 9 and is guided upwardly to be spread by the rollers of the spreader head 11 and simultaneously squeezed by the individual squeezing units 13 each including a pair 23 of inner squeezer rollers 23A, 23B and a cooperating outer single squeeze roller 26 with its adjustment power drive to be described in more detail below. This power drive of the squeezer units may, for example, be a piston cylinder device for radially adjusting the single squeeze roller toward and away of the corresponding pair of squeezing rollers 23A and 23B. In the squeezing units 13 the treatment liquor is squeezed out and collected in a liquor container 14 as the liquor runs off the tubular fabric 1.

Following the spreading and squeezing the fabric 1 passes through an upper spreader head 15 comprising a support roller pair 15A and a smoothing roller pair 15B. Downstream of the upper spreader head 15 the material is again in a flat spread out form and driven by drive rollers 16 arranged in the upper area of the machine frame 5 for pulling the spread and squeezed fabric out of the apparatus. If desired, a dancing roller may be arranged between the upper spreader head 15 and the pull-out rollers 16. Such a dancing roller arrangement assures that a constant pull-out force is applied to the fabric 1. Preferably, the dancing roller is mounted with components permitting an adjustable longitudinal tensioning force to be applied to the fabric.

Figure 2:
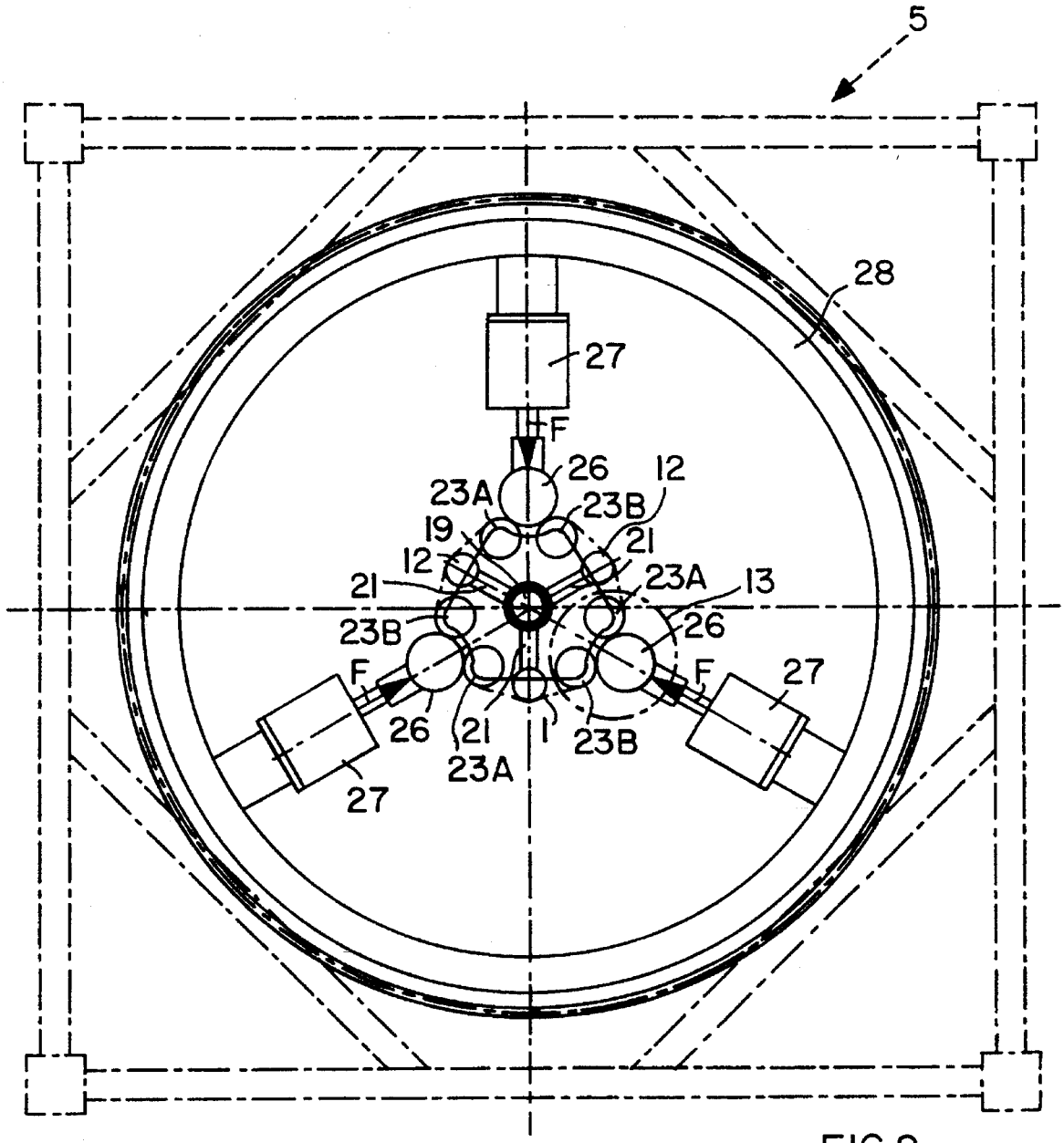
FIG. 2 is a sectional view along the section plane II—II in FIG. 1 illustrating the spreader components in a position for a minimal spreading of the tubular fabric.
Figure 3:
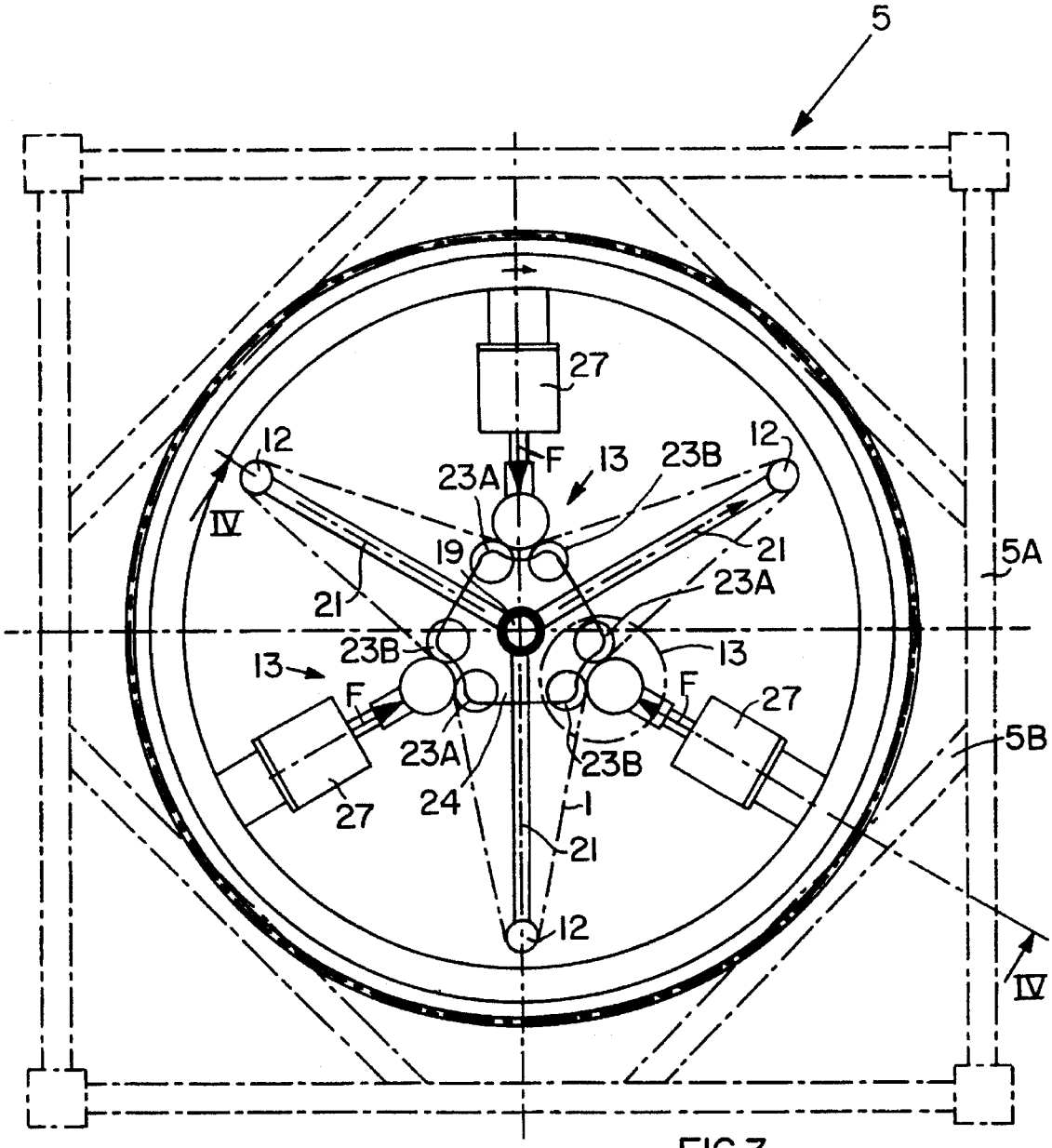
FIG. 3 is a view just as in FIG. 2, however illustrating a maximum spreading of the tubular fabric.
Figure 4:
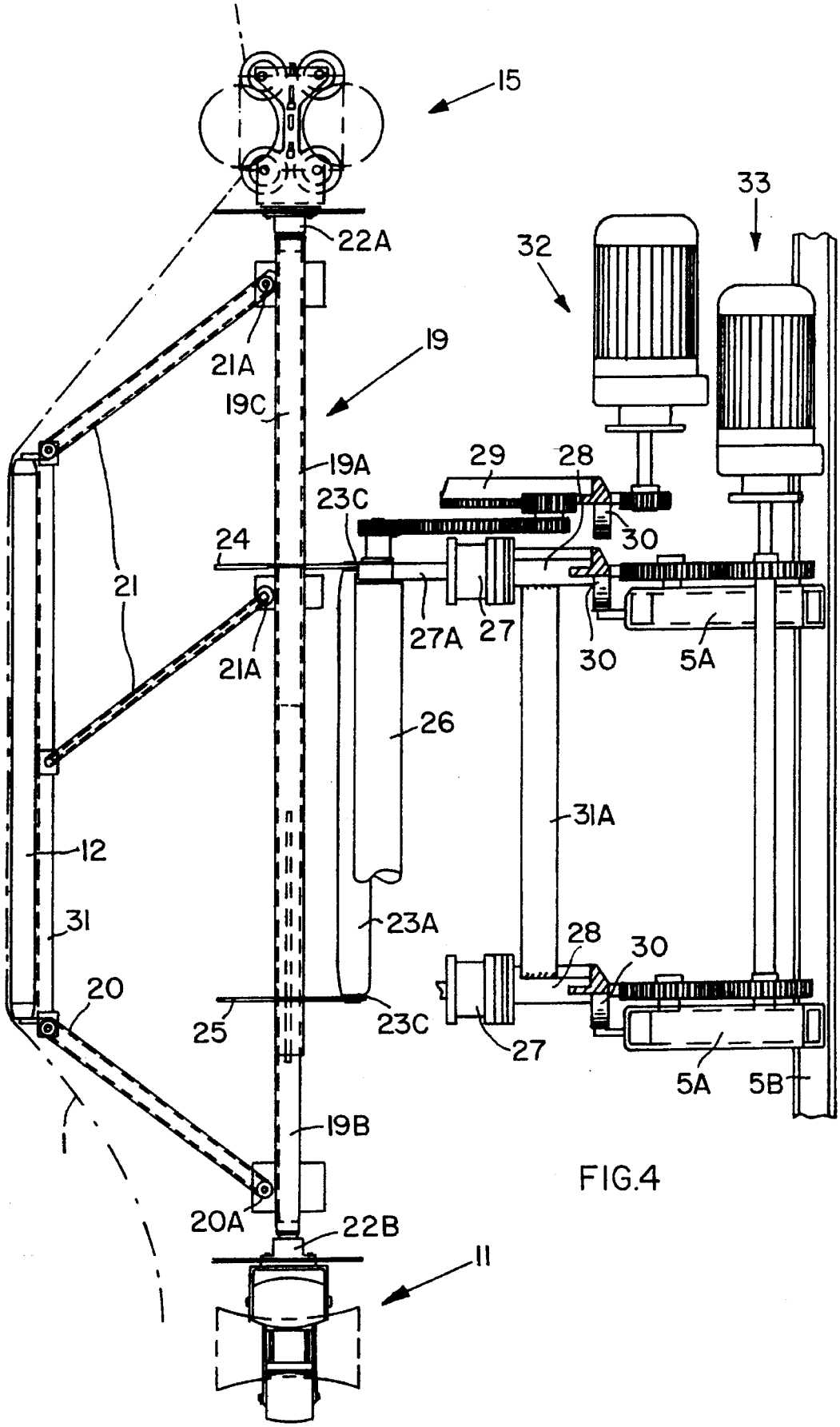
FIG. 4 is a sectional view toward section plane IV—IV in FIG. 3.

Referring further to FIG. 1, a carrier and position adjustment mechanism 17 is mounted in the lower section of the machine frame 5 for supporting and adjusting the spreader mechanism. The mechanism 17 can lift or lower the spreader head 11 as indicated by the double arrow 18. Thus, the mechanism 17 carrying the lower spreader head 11 is capable of telescoping the central spreader carrier column 19 shown in FIG. 1 in its elevational position. The column 19 in turn carries upper and lower braces or struts 20, 21 as best seen in FIG. 4. These braces or struts carry radially outwardly spreader rollers 12 also seen in FIGS. 2 and 3. The central column 19 comprises an outer pipe or pipe section 19A and an inner pipe section 19B telescoping inside the outer pipe section 19A. The upper end of the outer pipe section 19A is rotatably secured to the upper spreader head 19 through an upper rotary bearing 22A while the lower end of the inner pipe section 19B is mounted in a rotary bearing 22B to the lower spreader head 11 also as best seen in FIG. 4. Thus, the spreader and squeezer apparatus is rotatably mounted between the bearings 22A and 22B and accordingly also between the upper and lower spreader heads 11 and 15. The radially outer ends of the struts or braces 20, 21 carry at least one of the above mentioned spreader rollers 12 but are relieved of forces caused by the squeezing. As seen in FIGS. 2 and 3, three such spreader rollers 12 are provided on respective radially outwardly extending struts or braces.

Referring to FIGS. 2, 3 and 4 in conjunction, two squeezer rollers 23A and 23B form a pair 23. Each pair 23 cooperates with a single squeeze roller 26 that is radially adjustable toward and away relative to the central column 19 by a second power drive 27 to be described in more detail below. The just mentioned components form together the above mentioned squeeze unit 13. The squeezer rollers 23A and 23B are stationary in their radial position relative to the central column 19 rather than radially adjustable as is the case in the prior art. However, these rollers 23A, 23B are rotatably mounted in the above mentioned brackets 24 and 25 that are stationary relative to the column 19, but rotate therewith. A first power drive 32 with a motor driven gear train rotates the column 19 and therewith the brackets 24, 25 with the rollers 23A, 23B. The third power drive 33 also, for example in the form of a motor driven gear train, revolves the squeeze roller 26 and the second power drive 27 around the column 19.

As best seen in FIG. 4 the upper bracket 24 is mounted to the upper pipe section 19A between the upper struts or braces 21 while the lower bracket 25 is also mounted to the upper pipe section 19A, however below the central brace 21. The vertical spacing between the brackets 24 and 25 is so selected that the length of the squeezer rollers 23A and 23B is properly accommodated between the brackets 24 and 25 including the rotation bearings 23C of the squeezer rollers 23A and 23B.

The rotational bearings 23C of the roller pairs 23 are not vertically aligned with each other. Rather, it is essential that the upper bearings 23C are slightly displaced relative to the vertical determined by the lower bearings 23C in order to establish the above mentioned slight or acute angle a. It is important that this angle a is for example 1 to 5°. The angle is the same for all pairs 23 or squeezer rollers so that all have the same slanted position. Similarly, the angle is the same for the respective squeeze roller 26.

FIGS. 2 to 4 illustrate the arrangement of the individual squeezer units 13 with their squeezer roller pairs 23 and their single squeeze rollers 26 according to the invention. The tubular fabric 1, shown in FIG. 2, is guided on the one hand by the spreader rollers 12 and on the other hand by each squeezing gap in each squeezer unit 13. These gaps are established between the roller pair 23 and the respective adjustable single squeeze roller 26, whereby the gap can be adjusted in its width by operating the respective power drive 27. Adjustment of the squeeze gap also determines the squeezing force F. The rollers 23A, 23B and 26 are mounted so that their rotational aces pass through the corners of a triangle and so that the squeezing force components oppose each other directly.

The adjustable single squeeze rollers 26 are rotatably mounted with their free ends to the piston rod 27A of the power drive 27, e.g. a piston cylinder device 27 carrying these single squeeze rollers 26 on the one hand while simultaneously establishing the required squeezing force F by the mentioned adjustment. The piston cylinder device 27 forms the above mentioned second power drive and these power drives are mounted with the respective squeeze roller 26 in mounting or bearing rings 28 which are power driven by the third motor gear train 33.

The pair of bearing or mounting rings 28 is supported in the frame 5 as shown in FIG. 4. The two rings 28 are vertically interconnected by a column or columns 31A and rest on bearing rollers 30 which in turn are supported by horizontal frame members 5A. The column or columns 31A with their rings 28 are caused to revolve about the column 19 by the motor driven gear train 33 forming the third power drive. Further details regarding the construction of these drives are disclosed in the above mentioned U.S. Pat. No. 5,279,023. The first and third power drives are driven in synchronism with each other.

As mentioned above and as shown in FIG. 1, the slanted arrangement of the squeezing units 13 assures the desired all-around squeezing action simultaneously with the transport of the squeezed fabric upwardly toward the upper spreader head 15 and said roller arrangement 16.

It is important according to the invention that the squeezer roller pairs 23 are stationary relative to the column 19, however, mounted for rotation about their bearings 23C at a slant relative to the central column 19 so that the spreader elements such as rollers 12 can be mounted to the free ends of the struts or braces 20, 21 which are radially tiltable about their respective pivots 21A and 20A. Thus, the spreader forces are separated from the squeezer forces.

Although the invention has been described with reference to specific example embodiments, it will be appreciated that it is intended to cover all modifications and equivalents within the scope of the appended claims.

What is claimed is:

1. An apparatus for simultaneously spreading and squeezing tubular knit fabric, comprising a plurality of squeezer units (13), each squeezer unit comprising a squeezer roller pair (23A, 23B) rotatably mounted in stationary brackets (24, 25) secured to an outer pipe section (19A) of a central spreader carrier column (19) having a central longitudinal axis so that the squeezer roller pairs are separated from braces or struts (20, 21) of said central spreader carrier column (19), a single squeeze roller (26) cooperating with each squeezer roller pair (23A, 23B), a first power drive (32) for rotating said roller pair (23) about the single squeeze roller (26), a second power drive (27) for radially adjusting said squeeze roller (26) toward and away from the respective squeezer roller pair (23) for varying the squeezing force (F), a third power drive for revolving said single squeeze roller (26) and its respective second power drive (27) around said central column (19), a pair of mounting rings (28) for revolvingly supporting said squeeze roller (26) and its respective second power drive (27), and wherein said pair of rollers (23) and said single squeeze roller (26) are mounted with their rotational axes passing through the corners of a triangle so that squeeze force components applied by said second power drives (27) oppose each other, whereby loads are substantially reduced.

2. The apparatus of claim 1, wherein said squeezer units of said plurality of squeezer units (13) are mounted at uniform angular spacings around said mounting rings (28).

3. The apparatus of claim 2, comprising three squeezer units (13) mounted at 120° on-center angular spacings from each other on said mounting rings (28).

4. The apparatus of claim 1, further comprising bearings (23C) for rotatably mounting said squeezer rollers (23A, 23B) of said pair (23) in said brackets (24, 25).

5. The apparatus of claim 1, further comprising a machine frame (5) and a spreader unit mounted on said central spreader carrier column (19), said first power drive (32) driving a gear ring (29) rotatably mounted on rollers (30) in said machine frame (5), and wherein said pair of mounting rings (28) are also mounted on rollers (30) for rotation in said machine frame, wherein said third power drive comprises a gear train, said mounting rings (28) also having gear teeth forming part of said gear train of said third power drive, and wherein said pair of mounting rings (28) extend in horizontal planes that are parallel to a horizontal plane of the gear ring (29), and wherein all mounting rings and gear rings are surrounding the spreader unit.

6. The apparatus of claim 1, wherein said second power drive comprises piston cylinder units (27) which are angularly uniformly spaced around a respective mounting ring of said pair of mounting rings (28), said piston cylinder units (27) being rigidly connected to said pair of mounting rings, and wherein piston rods (27A) of said piston cylinder units extend radially toward said central axis of said central column (19) so that the respective squeeze roller (26) is positioned symmetrically relative to the respective pair of squeezer rollers (23A, 23B), each of which is arranged on one side of a line forming a radial extension of the respective piston rod and opposite each other across said extension line.

7. The apparatus of claim 1, further comprising a spreader unit secured to said central column rotatably mounted in a machine frame, said central column comprising said outer pipe section (19A) and an inner pipe section (19B) telescopingly received within said outer pipe section, and wherein said spreader unit further comprises struts (20, 21) pivoted radially inwardly to said central column and having radially outer ends pivoted to at least one longitudinal connector member (31), said spreader unit further comprising spreader rollers (12), at least one of which is rotatably supported by said longitudinal connector member (31).

8. The apparatus of claim 1, wherein said pair of squeezer rollers (23A, 23B) and said squeeze roller (26) have longitudinal rotational axes that extend at a slant relative to the central longitudinal axis of said central column (19).

* * * * *

UNITED STATES PATENT AND TRADEMARK OFFICE

CERTIFICATE OF CORRECTION

PATENT NO. : 5,519,922

DATED : May 28, 1996

INVENTOR(S) : Strudel

It is certified that error appears in the above-identified patent and that said Letters Patent is hereby corrected as shown below:

Col. 5, line 29, "a" should be -- $\alpha$ --.

Col. 5, line 30, "a" should be -- $\alpha$ --, "5°" should be --15°--.

Col. 5, line 31, "or" should be --of--.

Col. 5, line 46, "aces" should be --axes--.

Signed and Sealed this

First Day of October, 1996

Bruce Lehman

*Attest:*

BRUCE LEHMAN

*Attesting Officer*

*Commissioner of Patents and Trademarks*